US008256255B2

(12) United States Patent
Bosoni et al.

(10) Patent No.: US 8,256,255 B2
(45) Date of Patent: Sep. 4, 2012

(54) FINISHING STATION OF VARIABLE STRUCTURE FOR A MACHINE FOR THE FORMATION OF PIPES

(75) Inventors: Riccardo Bosoni, Agazzano (IT); Vittorio Travini, Borgo San Siro (IT)

(73) Assignee: Olimpia 80 S.r.l., Borgo San Siro (Pavia) (IT)

( * ) Notice: Subject to any disclaimer, the term of this patent is extended or adjusted under 35 U.S.C. 154(b) by 547 days.

(21) Appl. No.: 12/556,948

(22) Filed: Sep. 10, 2009

(65) Prior Publication Data

US 2010/0064760 A1 Mar. 18, 2010

(30) Foreign Application Priority Data

Sep. 12, 2008 (IT) ..... MI2008A001637

(51) Int. Cl.
*B21D 19/00* (2006.01)

(52) U.S. Cl. ..... 72/100; 72/52; 72/95; 72/235

(58) Field of Classification Search ..... 72/48, 51, 72/52, 95, 98, 100, 235, 237, 110, 120, 121
See application file for complete search history.

(56) References Cited

U.S. PATENT DOCUMENTS 4,299,108 A * 11/1981 Kato et al. ..... 72/178
5,607,098 A 3/1997 Kusakabe

FOREIGN PATENT DOCUMENTS

WO 9947284 9/1999
WO 0230586 4/2002

OTHER PUBLICATIONS

Priority Search Report dated Jun. 11, 2009 in priority application.

* cited by examiner

*Primary Examiner* — Edward Tolan
*Assistant Examiner* — Matthew G Katcoff
(74) *Attorney, Agent, or Firm* — Young & Thompson

(57) ABSTRACT

A finishing station of variable structure includes two plates, joined integrally to each other and able to slide along two vertical shoulders which support a plurality of forming rollers mounted on shoes able to slide in radial guides formed in the plates. The shoes that support the forming rollers are moved by levers hinged to the plates and connected to each other by connecting rods, two of which are hinged to levers hinged to the plates and secured to the ground. A further forming roller, situated in the lower part of the plates, is preferably secured to the ground. In the inner part of the two forming rollers situated in the upper part of the finishing station a disc blade is formed to control the position of the edges of the bent strip of sheet metal during the finishing operation.

7 Claims, 2 Drawing Sheets

FINISHING STATION OF VARIABLE STRUCTURE FOR A MACHINE FOR THE FORMATION OF PIPES

The present invention refers to a finishing station for a machine for the formation of pipes, which comprises a plurality of idle forming rollers movable along radial guides.

Machines for the formation of pipes by continuous bending of a strip of sheet metal are well-known to the art and comprise, in series with one another, a plurality of forming stations in which the strip of sheet metal is progressively bent by pairs of forming rollers to form the pipe, at least one finishing station comprising forming rollers which further bring together the edges of the bent strip of sheet metal to "close" the pipe consisting of the strip of bent sheet metal and a welding station for the edges of the pipe "closed" by the at least one finishing station.

Typically, the angle at the centre of the strip of bent sheet metal is 300°-320° at the exit from the plurality of forming stations and about 360° at the exit from the at least one finishing station.

Finishing stations of the prior art comprise a support which bears the forming rollers acting on the outer surface of the bent strip of sheet metal in order to bring close the edges of said strip and means able to prevent rotation of the pipe being formed.

These finishing machines of the prior art have the drawback of making it necessary to replace the forming rollers when it is desired (or necessary) to change the diameter of the pipe produced and this leads to more or less long machine downtimes which reduce the productivity of the plant.

Object of the present invention is to produce a finishing station of variable structure that does not have the drawback presented by finishing stations of the prior art since it allows pipes having a diameter within a preset range to be finished without having to replace the forming rollers.

This object is achieved by means of a finishing station of variable structure that has the characterising features set forth in independent claim 1.

Further advantageous characteristics of the invention form the subject matter of the dependent claims.

A finishing station realised according to the invention comprises two plates, integral with each other and sliding along two vertical shoulders, which support a plurality of idle forming rollers mounted on shoes able to slide in radial guides formed in the plates and, preferably, a further idle forming roller secured to the ground.

The shoes that support the forming rollers are moved by levers hinged to the plates which are connected to each other by connecting rods; two of the connecting rods are hinged to two levers, also hinged to the plates, secured to the ground.

In the inner part of each of the two forming rollers situated in the upper part of the plates, a disc blade is formed to control the position of the edges of the bent strip of sheet metal during the finishing operation.

The invention will now be described with reference to a purely exemplifying (and therefore non limiting) embodiment thereof illustrated in the appended figures, wherein.

In the appended figures corresponding parts will be identified by the same reference numerals.

Figure 1A:
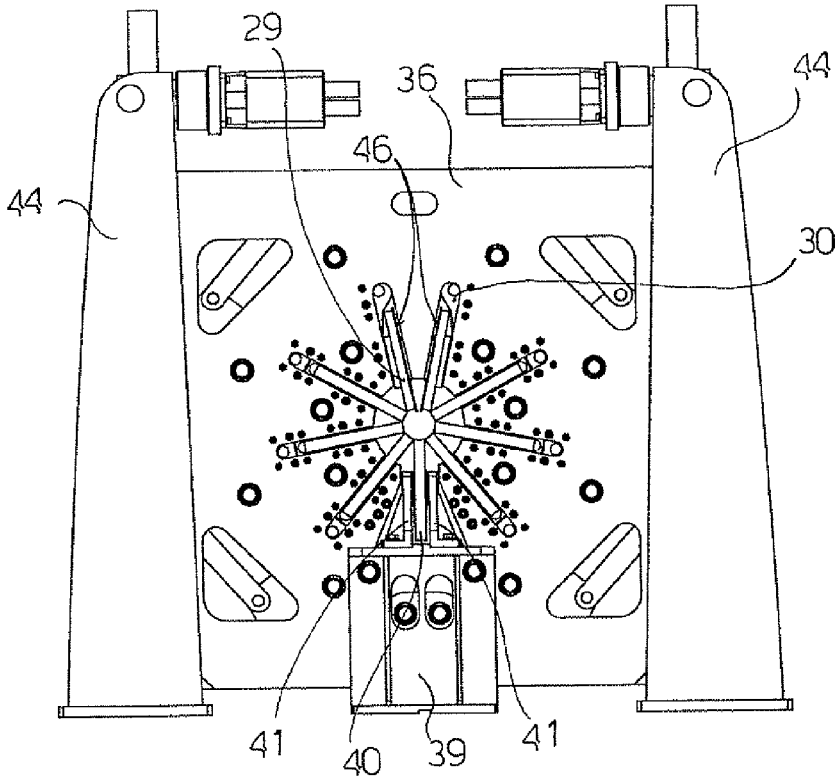
FIG. 1 shows the diagrammatically a front view (FIG. 1*a*) and a perspective view (FIG. 1*b*) of a finishing station realised according to the invention.
Figure 1B:
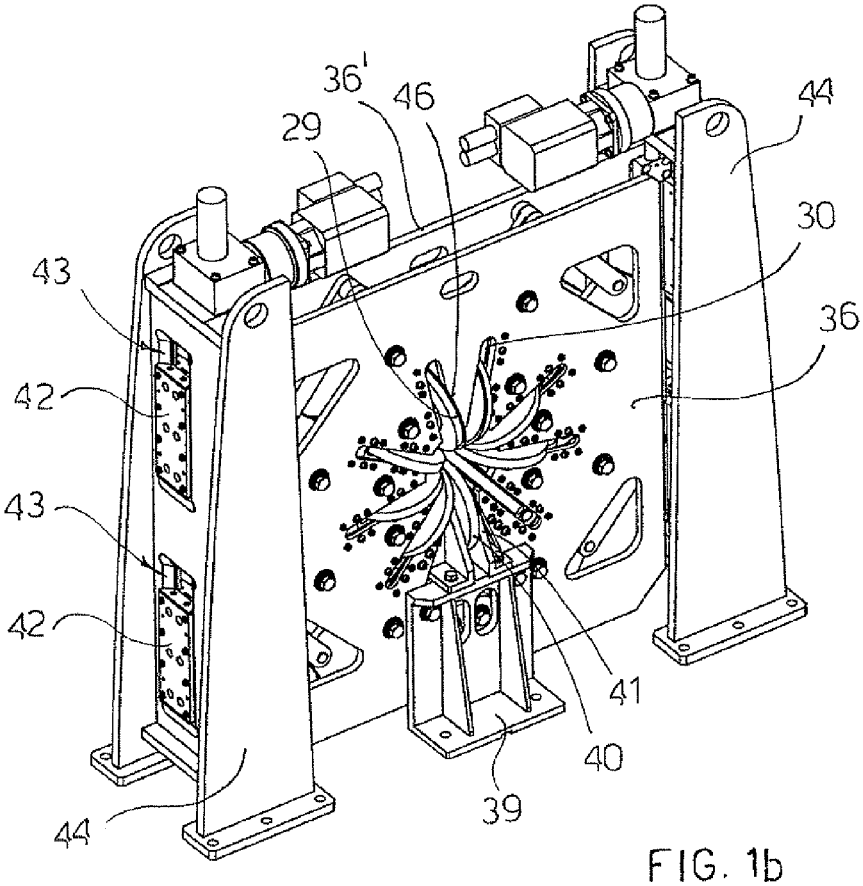

FIG. 1 shows diagrammatically a front view (FIG. 1*a*) and a perspective view (FIG. 1*b*) of a finishing station 1 realised according to the invention, which comprises the plates 36 and 36', joined integrally to each other and able to slide along two vertical shoulders 44, which support a plurality of idle forming rollers 29 mounted on shoes able to slide in radial guides 30 formed in the plates 36 and 36' and an idle forming roller 40, situated in the lower part of the plates 36 and 36', which slides in a seat formed in said plates which is secured to the ground, preferably by means of brackets 39.

Figure 2:
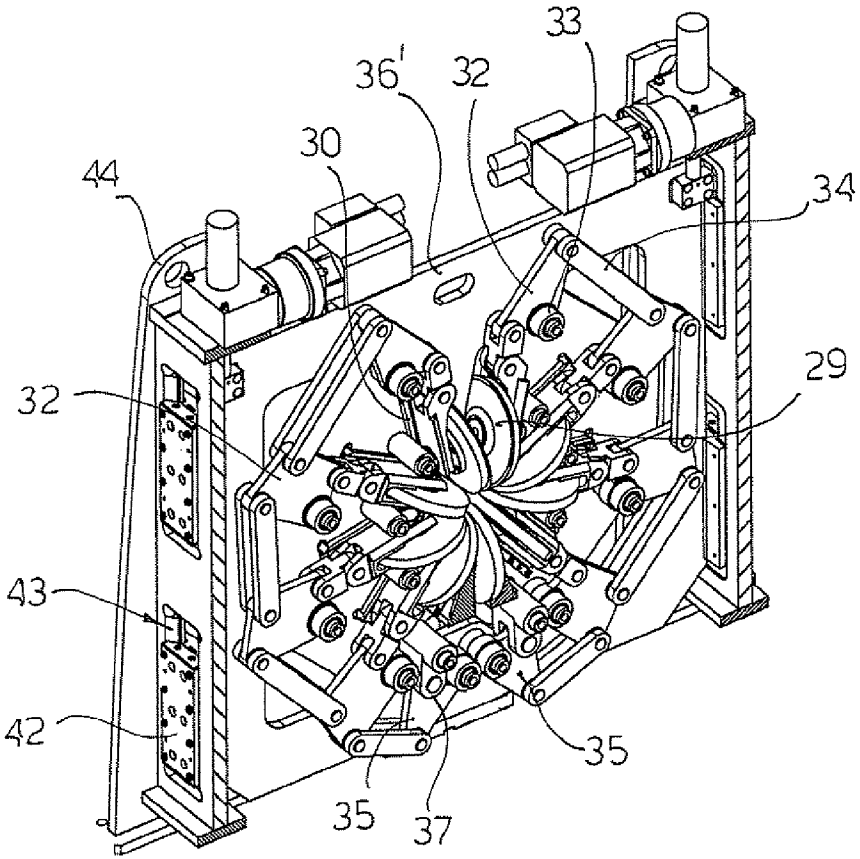
FIG. 2 shows diagrammatically the finishing station of FIG. 1*b* without the front plate.

In FIGS. 1 and 2 only one of the forming rollers 29 and only one of the radial guides 30 have been designated with the relative reference numerals for simplicity of the graphic representation.

The plates 36 and 36' advantageously comprise at least one pair of shoes 42 (two pairs in the appended figures) which slide in at least one pair of guides 43 (two pairs in the appended figures) formed in the vertical shoulders 44.

In the inner part of each of the forming rollers 29 situated in the upper part of the plates 36 and 36' a disc blade 46 is formed which, during the finishing operation, controls the position of the edges of the bent strip of sheet metal.

The disc blade 46 can be omitted if the angle at the centre of the bent strip of sheet metal leaving the finishing station 1 has reached about 360°.

FIG. 2 shows diagrammatically a perspective view of the finishing station 1 of FIG. 1*b*, without the front plate 36.

As shown in FIG. 2, the shoes that support the forming rollers 29 are moved by levers 32, hinged to the plates 36 (omitted in FIG. 2) and 36', which are connected to each other by connecting rods 34, two of which are hinged to levers 35 hinged to the plates 36 and 36' and secured to the ground, preferably by means of a connecting rod 37 hinged to the brackets 39 (FIG. 1).

The forming rollers 29 and 40 have a circular profile with a radius of curvature corresponding to the maximum curvature of the pipe expected to be finished off with the finishing station 1.

A vertical movement of the plates 36 and 36' (achieved by means of driving means not explicitly indicated because they are per se known) causes a rotation of the levers 35, secured to the ground (preferably) by connecting rods 37, which is transmitted by the connecting rods 34 to the levers 32 which, in turn, cause the shoes supporting the forming rollers 29 to slide in the radial guides 30 formed in the plates 36 and 36'.

The system of connecting rods 34 makes equal the radial movements along the guides 30 of the shoes and the forming rollers 29, which are therefore equidistant from the centre of the pipe being formed; this makes it possible to adapt the position of the forming rollers 29 simply and effectively to the diameter of the pipe being formed.

The idle forming roller 40 situated in the lower part of the plates 36 and 36' is preferably secured to the ground by means of the brackets 39 to maintain the lower tangent of the bent strip of sheet metal at constant height with respect to the ground, that is, to realise a "fixed bottom groove" mechanism. Without departing from the scope of the invention, the forming roller 40 also may be supported by a shoe moved by the levers 32.

Figure 3:
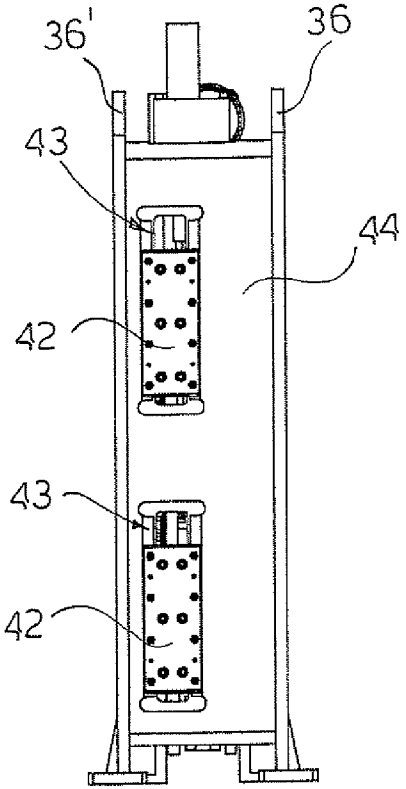
FIG. 3 shows diagrammatically a side view of the finishing station of FIG. 1.

FIG. 3 shows diagrammatically a side view of the finishing station 1, in which can be seen the guides 43, formed in the shoulders 44, wherein the shoes that support the plates 36 and 36' slide.

Without departing from the scope of the invention, a person skilled in the art can make to the above described finishing station all the modifications and improvements suggested by normal experience and/or by the natural evolution of the art.

The invention claimed is:

1. A finishing station (1) of variable structure for a machine for the formation of pipes by bending a strip of sheet metal, characterized by comprising two plates (36, 36'), integrally joined with each other and sliding along two vertical shoulders (44), that support at least a plurality of forming rollers (29) mounted on sliding shoes able to slide in radial guides (30) formed in the plates (36, 36'), the sliding shoes which support the forming rollers (29) being moved by levers (32) hinged to the plates (36, 36') and connected to each other by connecting rods (34), two of the connecting rods (34) being hinged to levers (35) in turn hinged to the plates (36, 36') and secured to the ground.

2. The finishing station (1) as in claim 1, characterized in that, in the inner part of each of the two forming rollers (29) situated in the upper part of the plates (36, 36'), there is a disc blade (46) able to control, during the finishing operation, the position of the edges of the bent strip of sheet metal.

3. The finishing station (1) as in claim 1, characterized in that the levers (35) are secured to the ground by means of a couple of connecting rods (37) hinged to two brackets (39) integral with the ground.

4. The finishing station (1) as in claim 1, characterized in that the plates (36, 36') include at least one pair of sliding shoes (42) able to slide in at least one pair of guides (43) formed in the vertical shoulders (44).

5. The finishing station (1) as in claim 1, characterized by also comprising a forming roller (40), situated in the lower part of the plates (36, 36'), which slides in a seat formed in said plates and which is secured to the ground.

6. The finishing station (1) as in claim 1, characterized in that the forming rollers (29, 40) have a circular profile with a radius of curvature corresponding to the maximum curvature of the pipe to be finished off with the finishing station (1).

7. The finishing station (1) as in claim 5, characterized in that the forming rollers (29, 40) have a circular profile with a radius of curvature corresponding to the maximum curvature of the pipe to be finished off with the finishing station (1).

* * * * *